US009700147B2

(12) United States Patent
Kim Thi Pham

(10) Patent No.: US 9,700,147 B2
(45) Date of Patent: Jul. 11, 2017

(54) SITTING DEVICE FOR PREVENTION OF SPINAL DISEASES

(71) Applicant: Loan Kim Thi Pham, Ho Chi Minh (VN)

(72) Inventor: Loan Kim Thi Pham, Ho Chi Minh (VN)

( * ) Notice: Subject to any disclaimer, the term of this patent is extended or adjusted under 35 U.S.C. 154(b) by 29 days.

(21) Appl. No.: 14/622,070

(22) Filed: Feb. 13, 2015

(65) Prior Publication Data

US 2015/0223611 A1 Aug. 13, 2015

Related U.S. Application Data

(63) Continuation-in-part of application No. PCT/IB2012/054164, filed on Aug. 15, 2012.

(51) Int. Cl.
*A61G 5/10* (2006.01)
*A47C 9/00* (2006.01)
(Continued)

(52) U.S. Cl.
CPC ..... *A47C 9/005* (2013.01); *A47C 3/16* (2013.01); *A47C 15/004* (2013.01)

(58) Field of Classification Search
CPC ..... A47C 7/021; A47C 16/04; A47C 15/004
(Continued)

(56) References Cited

U.S. PATENT DOCUMENTS

D267,028 S * 11/1982 Spisak ..... D21/686
4,673,216 A * 6/1987 Alfer ..... 297/452.27
(Continued)

FOREIGN PATENT DOCUMENTS

JP H57-198959 12/1982
JP H60-097062 7/1985
(Continued)

OTHER PUBLICATIONS

International Search Report for PCT Application No. PCT/IB2012/054164 issued Apr. 18, 2013.
(Continued)

*Primary Examiner* — Nicholas Polito
*Assistant Examiner* — Ifeolu Adeboyejo
(74) *Attorney, Agent, or Firm* — BN IP-Consulting LLC; Binh-An Nguyen

(57) ABSTRACT

A sitting device for prevention of spinal diseases comprises a padded member, a thin pad extended forwardly from the padded member, and a hard block fully inserted inside the padded member. The padded member has a generally hexagonal shape, and is made of resilient materials. The hypotenuse surface of the padded member is undulating economically. The hard block is made of a non-resilient material, and is able to tolerate, without rupturing, the gravity force on a mass of an adult's body with a shape and size similar to those of the adult's buttocks. The hard block is inserted completely inside the right angle area of the padded member. The height of the front side of the hard block is greater than the distance from the lowest point of the sitter's coccyx to the lowest point of his tuberosity of the sacrum. This will always keep the sacrum in a position higher than that of two seating areas keeping the pelvis upright and symmetric. Both the padded member and the hard block have a flat bottom side to ensure stability.

1 Claim, 5 Drawing Sheets

(51) Int. Cl.
*A47C 3/16* (2006.01)
*A47C 15/00* (2006.01)

(58) Field of Classification Search
USPC ..... 5/419, 653, 654, 654.1
See application file for complete search history.

(56) References Cited

U.S. PATENT DOCUMENTS

| | | | | | |
|---|---|---|---|---|---|
| D293,286 | S | * | 12/1987 | Alfer | D6/596 |
| 4,951,334 | A | * | 8/1990 | Maier | 5/653 |
| D318,392 | S | * | 7/1991 | Edelson | D6/601 |
| 5,029,350 | A | * | 7/1991 | Edelson | 5/652 |
| 5,134,740 | A | * | 8/1992 | Summer | 5/652 |
| 5,317,773 | A | * | 6/1994 | Graebe | 5/653 |
| 5,433,505 | A | * | 7/1995 | Coyne et al. | 297/284.1 |
| 5,855,415 | A | * | 1/1999 | Lilley, Jr. | 297/452.27 |
| 6,163,905 | A | * | 12/2000 | Noldus-Nilsen | 5/655.3 |
| 6,623,270 | B1 | * | 9/2003 | Meldeau | 432/140 |
| 7,024,712 | B2 | * | 4/2006 | Fujita et al. | 5/653 |
| 2002/0069464 | A1 | * | 6/2002 | Welsh | 5/653 |
| 2006/0037143 | A1 | * | 2/2006 | Green | 5/653 |
| 2007/0143927 | A1 | * | 6/2007 | Noro et al. | 5/653 |

FOREIGN PATENT DOCUMENTS

| | | |
|---|---|---|
| JP | H62-002658 | 1/1987 |
| JP | S06-70655 | 10/1994 |
| JP | H10-014716 | 1/1998 |
| JP | 2003-245166 | 9/2003 |

OTHER PUBLICATIONS

International Preliminary Report on Patentability issued Feb. 17, 2015.

* cited by examiner

SITTING DEVICE FOR PREVENTION OF SPINAL DISEASES

PRIORITY CLAIM

This application is a continuation-in-part of PCT Application No. PCT/IB2012/054164, filed Aug. 15, 2012.

BACKGROUND OF THE INVENTION

1. Field of the Invention

The present invention relates to a sitting device used for sitting on flat surfaces and that device is able to prevent spinal diseases, such as cervical, thoracic, and lumbar diseases, to occur.

2. Description of the Relevant Art

Wrong sitting postures lead to many spinal diseases. Sitting in a correct posture (see FIG. 8A) means keeping the pelvis in its neutral position, like in the same position when a person is standing, i.e. both right and left pelvis are upright, symmetrically arranged in two sides of the sacrum in a position higher than that of the two seating areas and located at the center. When the pelvis is in a neutral position, they allow the spine to not tilt to the right or the left and remain in its natural curve as the S-letter, meaning the whole body weight is distributed and balanced evenly over the vertebrates and discs of the spine. As a result, spinal diseases are less likely to happen. However, when sitting on flat surfaces, such as a floor, it is very hard to always sit in a posture that keeps the pelvis in such a neutral position, because the feet and two buttocks are in the same plane, the sacrum will be lowered due to the pelvis's sliding forward, the spine shall be bent, changing its posture from the S-letter to the C-letter, the vertebrae shall be pressed in the front parts and opened in the rear, causing back pain due to excessive pressure, pinching the disc, leading to its protrusion backwards to press on the nerves or the spinal cord and the pelvis, sacrum, coccyx is deflected and distorted, losing their balances that result in a change of the pelvic shape such as distortion, humpback and loss of curvature. Over time, sitting in wrong postures leads to many spinal diseases such as cervical, thoracic, and lumbar diseases. As a result, the person experiences back, neck and joint pain, tension-headaches, fatigue and stress related conditions, and many other health problems such as disc herniation, spondylolisthesis. Examples of wrong sitting postures have been shown in FIGS. 8B and 8C, wherein FIG. 8B illustrates the severe exhaustion sitting posture and FIG. 8C shows the degenerative exhaustion sitting posture.

In fact, many people have to sit on flat surfaces, such as on the floor, for the long time due to different reasons, for example, to do their work, to meditate, or to attend religious sessions. Without any supporting device to keep the pelvis in a straight posture while sitting underground, they soon experience back pain and commonly encounter one or some of the spinal diseases mentioned above.

Many devices have been invented to provide support when sitting on flat surfaces. However, they do not provide stable support that keeps the pelvis always in its neutral position, i.e., the key to sitting in a correct posture. Zafus is one of those. Stuffed with fluffy, soft, downy materials, a zafu or seat cushion raises the hips and partially absorbs the reaction force generated by the floor under the gravity force of the body of a sitter, making sitting in a leg-folding posture or the crossed-legged posture, a.k.a. Lotus sitting posture, more comfortable. However, due to the use of the fluffy materials, a zafu does not provide a stable support; the sitter's pelvis, coccyx can tilt in various directions depending on the sitting posture, eventually causing back pain and other spinal problems.

U.S. Pat. No. 6,141,807 discloses an adjustable height pillow that can "encourage proper sitting positions." However, the pillow is stuffed with a soft flexible material in order to primarily form a shape to hold the whole croup, therefore cannot provide a stable support to keep the pelvis always in its neutral position.

U.S. Pat. No. 5,652,983 presents a sit/sleep constructed pillow that can provide comfort when sitting on it. However, it also does not provide stable support that can keep the pelvis in its neutral position.

SUMMARY OF THE INVENTION

For at least the reasons discussed, there is a need to invent a device used for sitting on flat surfaces. That sitting device must provide stable support, having a terraced shape corresponding to hierarchical structure of the sacrum, coccyx, the seating tuberosity and rigidity, not changing its subsidence or tilting under the impact of body weight, that keeps a sitter's pelvis always in its neutral position, allowing the sitter to stay in a sitting posture with the pelvis being upright and symmetric, thereby preventing the spine from being tilted, distorted, or humpbacked. The sitting device, therefore, is able to prevent many spinal diseases related to wrong sitting postures including cervical, thoracic, and lumbar diseases. It is an object of the present invention to provide such a sitting device for the protection of the spine and sacrum.

According to the invention, the sitting device for prevention of spinal diseases comprises a padded member, a thin pad extended forwardly from the padded member, and a hard block fully inserted inside the padded member; when looked from the left or the right side, the padded member has a generally hexagonal shape, and is made of resilient materials such as foam, rubber, or cotton to make the device comfortable to sit on; the area of the hypotenuse surface of the padded member together with the area of the thin pad is wider than the total area of a sitter's buttocks, upper legs, and knees so that the sitter can sit, in a leg-folding posture, fully on the sitting device without any part of his body touching the flat surface of the floor outside; the hard block is disposed inside a soft padded member, made of a non-resilient material such as wood, polystyrene foam, or hard rubber; the hard block is able to tolerate, without deformation, the gravity force on a mass of an adult's body and this hard block is computed so that its height can fill-in the distance from the lowest point of the sacrum to the lowest point of the sitting tuberosity, the height of the front side of the hard block is greater than the distance from the lowest point of the sitter's coccyx to the lowest point of his tuberosity of the sacrum, therefore this hard block can tightly keep the pelvis, sacrum in a upright and symmetric posture, and the hard block of this height has a terraced shape in the top to bottom according to anatomical proportion, to ensure supporting each part, of the sacrum, coccyx, seating tuberosities, in order to keep the pelvis and sacrum being upright, symmetric, there by preventing the cervical, thoracic, lumbar spine from being spinal diseases.

To use the sitting device properly, a sitter needs to sit in a leg-folding sitting posture; in which, his buttocks are on top of the highest portion of the padded member, his upper legs lie along the hypotenuse surface of the padded member, and both of his left and right lower legs must rest inside the thin pad and fold along the long side of the thin pad and the right one is on top of the left one. Instead, the sitter can also sits in a cross-legged sitting posture a.k.a. Lotus sitting posture. Importantly, the sitter needs to adjust his buttocks so that his sacrum and coccyx are elevated by the top part of the hard block, and his ischium stays close to the front side of the hard block. That way, his pelvis is always "locked" in its neutral position, making the sitter sit always in a very upright posture from the neck to the lumbar, thereby his head, neck, and lumbar are aligned just in a straight axis starting from the head to the center of the spine and the center of the sacrum, thereby preventing spinal diseases related to wrong sitting postures including cervical, thoracic, and lumbar diseases to occur. If there were no hard block (as described above) inserted inside the padded member as described, the sitter's pelvis would tilt, distort freely, leading to degenerative exhaustion sitting postures.

BRIEF DESCRIPTION OF THE DRAWINGS

The invention will be better understood when consideration is given to the following detailed description thereof. Such description makes reference to the annexed drawings wherein.

Figure 1:
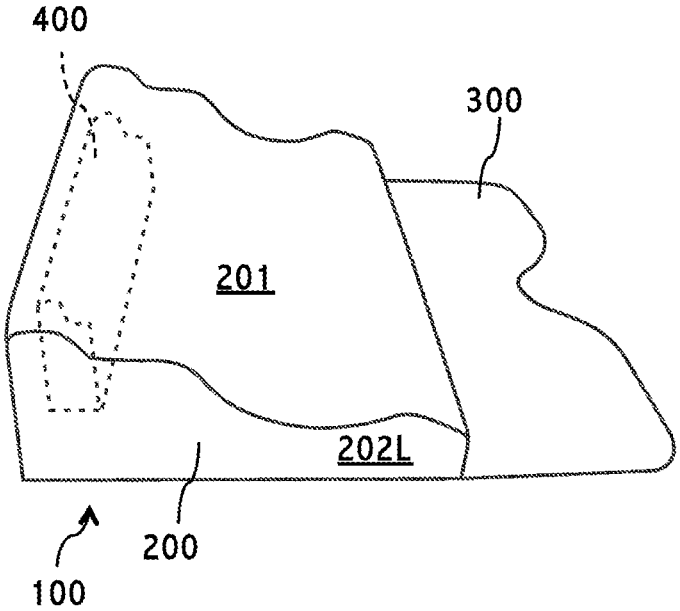
FIG. 1 is a left perspective view of a sitting device for prevention of spinal diseases according to the invention.

While the invention may be susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF THE PREFERRED EMBODIMENTS

The present invention provides a sitting device that is used for sitting on flat surfaces. The sitting device is able to keep the sitter in a upright sitting posture, preventing the head, neck, lumbar, spine from being humpbacked, distorted by keeping his pelvis always in its neutral position.

According to the invention, as shown in FIGS. 1-5, the sitting device 100, as shown in FIG. 1, comprises a padded member 200, a thin pad 300 extended forwardly from the padded member 200, and a hard block 400 fully inserted inside the padded member 200. Looked from the left side 202L, indicated in FIG. 1, or the right side 202R, indicated in FIG. 2, the padded member 200 has a generally hexagonal shape, and is made of resilient materials such as foam, rubber, or cotton to make the device 100 comfortable to sit on. The hypotenuse surface 201 of the padded member 200 is undulating ergonomically to ensure extra comfort for the sitter. The area of the hypotenuse surface 201 of the padded member 200 together with the area of the thin pad 300 is wider than the total area of a sitter's buttocks, upper legs, and knees, so that the sitter can sit fully on the sitting device 100 without any part of his body touching the fiat surface. The hard block 400 is made of a non-resilient material such as wood, polystyrene foam, or hard rubber, etc. The hard block having a terraced shape 400 is able to tolerate, without deformation, the gravity force on a mass of an adult's body and this hard block is computed so that its height can fill-in the distance from the lowest point of the sacrum to the lowest point of the sitting tuberosity, and the height H, indicated in FIG. 3, of the front side 403 of the hard block 400, is greater than the distance from the lowest point of the sitter's coccyx to the lowest point of his sitting tuberosities of the sacrum, thereby always raising the sacrum, coccyx above two sitting tuberosities of the pelvis in order to occupy this entire distance, assisting the coccyx always being in a position higher than that of the sitting tuberosities, therefore this hard block can tightly keep the pelvis, sacrum in a upright and symmetric posture, this property of the hard block can ensure the pelvis, sacrum being in a upright and symmetric posture, and the hard block of this height has a terraced shape in the top to bottom according to anatomical proportion, thereby preventing the spine from being humpbaked, bent, distorted when directly sit on the hard floor, the hard block is disposed inside the soft padded member having dimensions similar to those of an adult's buttocks. The hard block 400 is inserted completely inside the highest area of the padded member 200. Both the padded member 200 and the hard block 400 have a flat bottom side to ensure stability.

Figure 2:
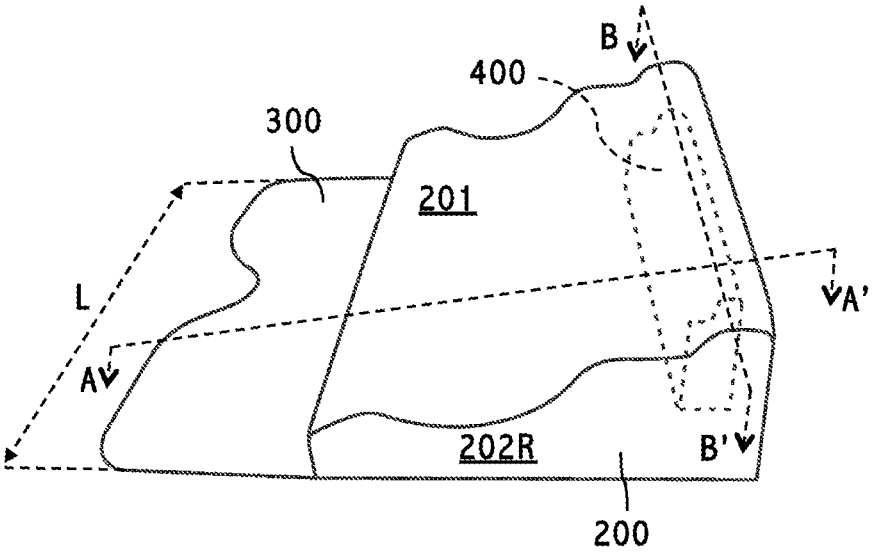
FIG. 2 is a right perspective view of the sitting device shown in FIG. 1.
Figure 3:
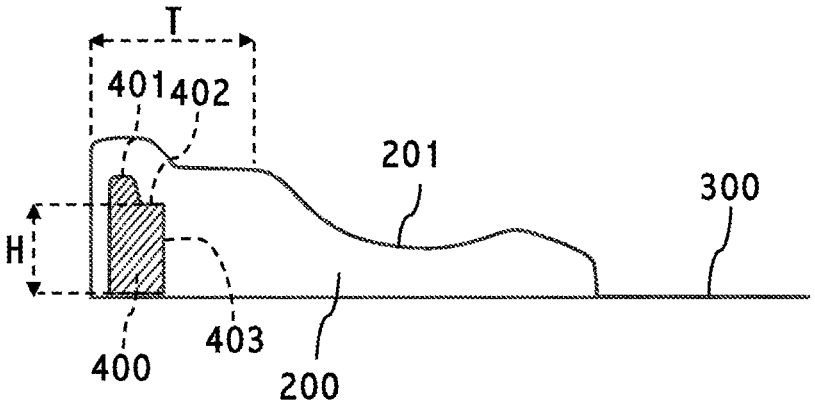
FIG. 3 is a cross-sectional view of the sitting device of FIG. 1 along the line A-A' shown in FIG. 2.
Figure 4:
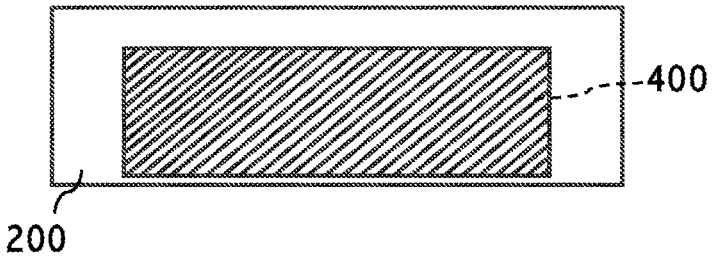
FIG. 4 is a cross-sectional view of the sitting device of FIG. 1 along the line B-B' shown in FIG. 2.
Figure 5:
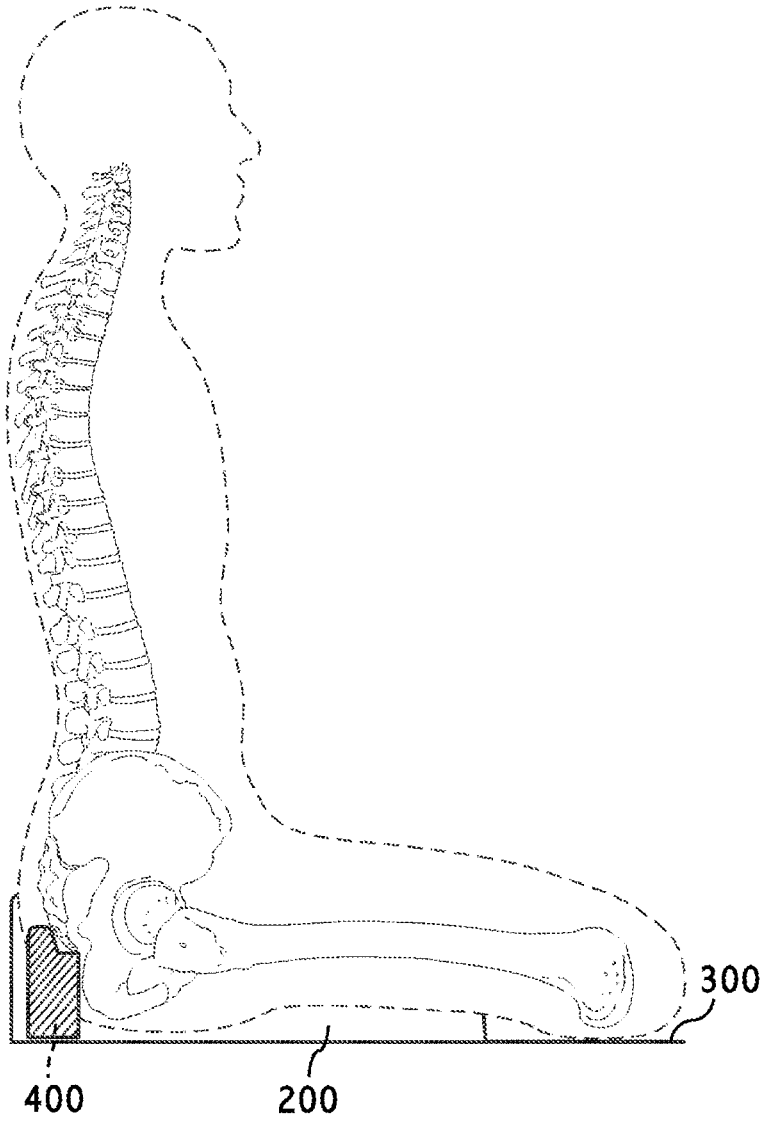
FIGS. 5-7 illustrates how to use the pillow of FIG. 1.
Figure 6:
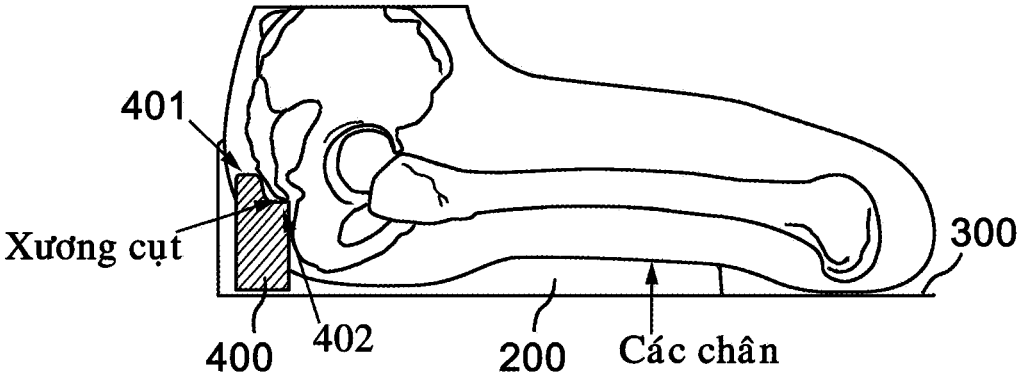
Figure 7:
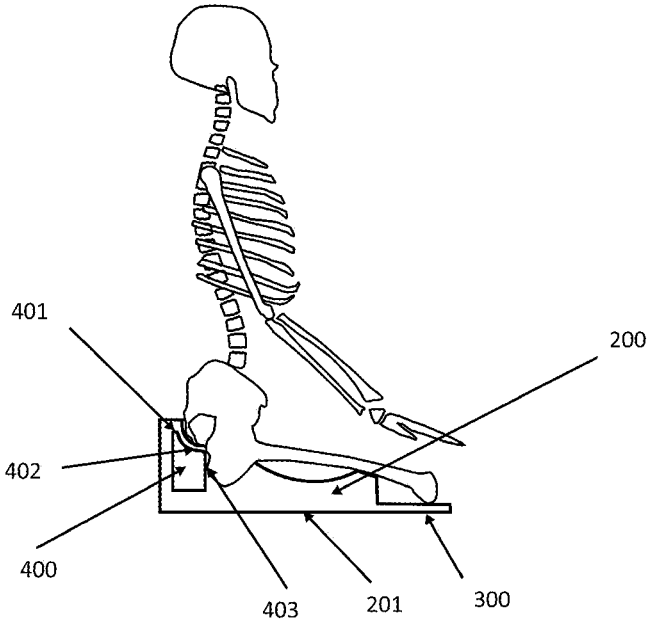
Figure 8A:
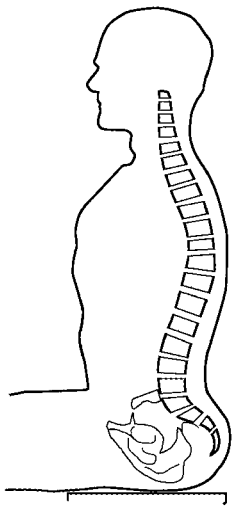
FIGS. 8A-8C show the energy efficient sitting posture, severe exhaustion sitting posture, and degenerative exhaustion sitting posture, respectively.
Figure 8B:
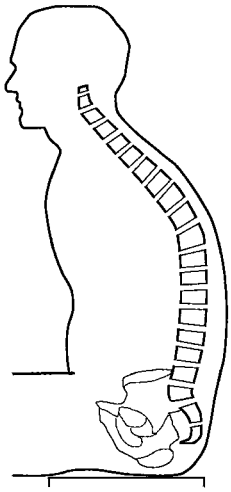
Figure 8C:
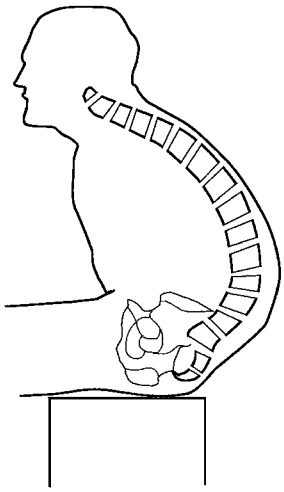

According to FIGS. 5-7, to use the sitting device 100 properly, a sitter needs to sit in a leg-folding sitting posture in which, his buttocks are on top of the highest portion T, indicated in FIG. 3, of the padded member 200, his upper legs lie along the hypotenuse surface 201 of the padded member 200, and both of his left and right lower legs must rest inside the thin pad 300 and fold along the long side L, indicated in FIG. 2, of the thin pad 300, and the foot of one leg is adjacent to the knee of the other leg. Instead, the sitter can also sits in a cross-legged sitting posture a.k.a. Lotus sitting posture (see FIG. 7). Importantly, the sitter needs to adjust his buttocks so that his sacrum is elevated by the highest area 401 of the hard block 400, his coccyx rests on the plateau area 402 of the hard block 400, and his ischium stays close to the front side 403 of the hard block 400.

That way, his pelvis is always "locked" in its neutral position, making the sitter sit in a correct posture which prevents spinal diseases related to wrong sitting postures including cervical, thoracic, and lumbar diseases to occur. If there were no hard block 400 inserted inside the padded member 200 as described, the sitter's pelvis would tilt freely, leading to the asymmetry of the sacrum, coccyx and the spine being distorted, humpbacked, loss of the normal curvature.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A sitting device for prevention of spinal diseases while sitting on the floor comprising:

a padded member to support a user's buttocks and upper legs; wherein the padded member has a left side, a right side, a front side, a rear side, an undulating or wavy hypotenuse surface, and flat bottom; the undulating or wavy hypotenuse surface configured to correspond with hierarchical structure, from high to low, of a user's sacrum, coccyx, and sitting tuberosities;

a thin pad extended forwardly from the padded member, wherein the thin pad provides cushioning under the knees of the user and helps keep the user's knees clean during use; and a hard block fully inserted inside the padded member, wherein the hard block is configured to assist in keeping the user's pelvis in an upright position and symmetrical during use;

wherein the hard block, has a hexagonal shape that has a rear side taller than a front side; wherein the rear side is parallel to the front side;

wherein the hard block is a homogeneous block made of a non-resilient material, wherein the hard block does not change rigidity, and does not tilt under impact of the user's body weight, thereby keeping the user's pelvis in the upright and symmetrical position;

wherein the hard block is capable of resisting the user's body weight, without deformation; and wherein the hard block is configured so that the height of a rear portion of the hard block can fill-in the distance from the lowest point of the user's sacrum to the lowest point of the user's sitting tuberosities; and wherein the height of a front portion of the hard block is higher than the distance from the lowest point of the user's coccyx to the lowest point of the user's tuberosities of the sacrum, to ensure each part of the user's sacrum, coccyx, and sitting tuberosities is supported in order to keep the user's pelvis and sacrum upright and symmetrical, thereby preventing spinal diseases.

* * * * *